United States Patent [19]

Rempel et al.

[11] 4,086,131

[45] Apr. 25, 1978

[54] METHOD FOR PRESSING BAGASSE WEBS

[75] Inventors: Cornelius N. Rempel; Merle G. Linkletter, both of Beloit, Wis.

[73] Assignee: Beloit Corporation, Beloit, Wis.

[21] Appl. No.: 574,878

[22] Filed: May 6, 1975

[51] Int. Cl.[2] ..... D21F 3/04; D21F 3/06

[52] U.S. Cl. ..... 162/203; 162/205; 162/206; 162/305; 162/360 R

[58] Field of Search ..... 162/203, 205, 206, 290, 162/301, 305, 306, 359, 360 R, 96

[56] References Cited

U.S. PATENT DOCUMENTS

| | | | |
|---|---|---|---|
| 2,209,757 | 7/1940 | Berry | 162/360 R |
| 2,694,348 | 11/1954 | Beachler | 162/360 X |
| 3,013,932 | 12/1961 | Hinrichs et al. | 162/96 X |
| 3,573,161 | 3/1971 | Notbohm | 162/301 |
| 3,797,384 | 3/1974 | Hoff | 162/360 X |
| 3,861,996 | 1/1975 | Dorfel | 162/360 X |

FOREIGN PATENT DOCUMENTS

| | | | |
|---|---|---|---|
| 699,107 | 12/1964 | Canada | 162/360 R |

*Primary Examiner*—Richard V. Fisher
*Attorney, Agent, or Firm*—Hill, Gross, Simpson, Van Santen, Steadman, Chiara & Simpson

[57] ABSTRACT

A method and mechanism for forming a continuous traveling web from bagasse fibers including forming a web between a pair of looped traveling wires to dewater from both sides of the formed web, lifting the formed web off of one of the wires and immediately passing the web through a first press nip sandwiched between two press felts with the web continually being supported between the forming wire and first nip, carrying the web on the upper side of one of the felts to a second nip and passing the web between two felts in the second nip, bringing the web to a dryness of at least 30% in the first two double felted nips, transferring the web onto a plain roll and passing it through third and fourth nips on the plain roll with felts outwardly of the web and removing the web from the plain roll to transfer it to a dryer section. Pressure is applied to the bagasse web in the range of 200 to 250 pli in the first nip, 300 to 350 pli in the second nip, 350 to 400 pli in the third nip, and in excess of 500 pli in the fourth nip.

4 Claims, 3 Drawing Figures

Fig. 1
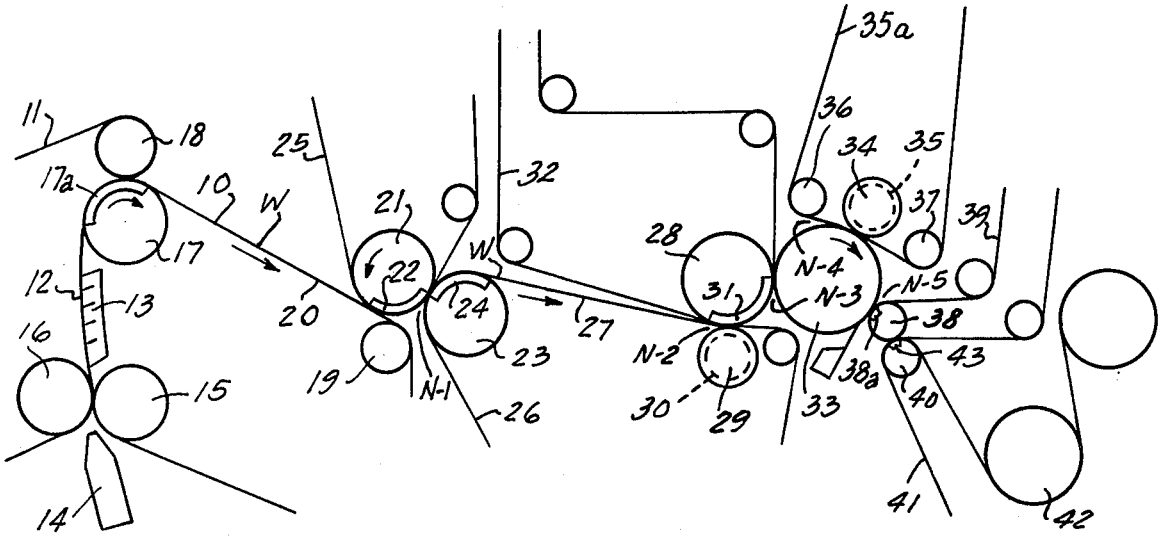
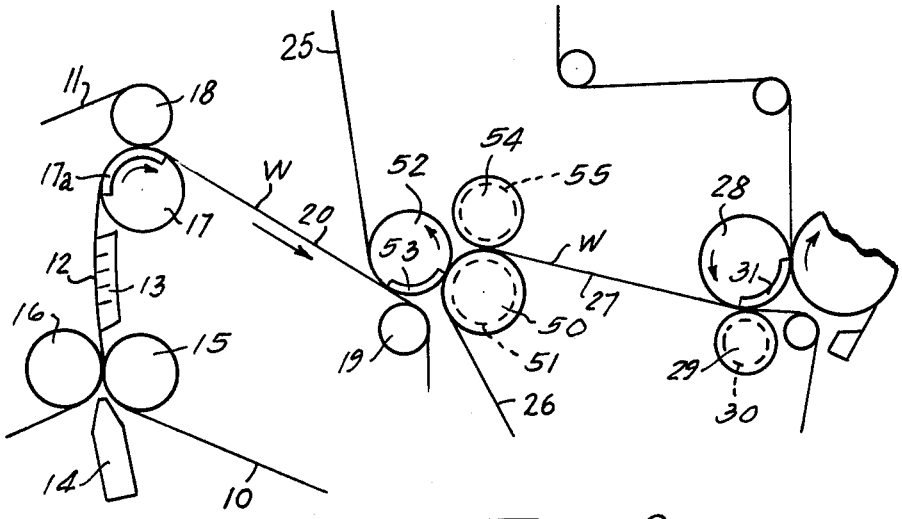
Fig. 2

METHOD FOR PRESSING BAGASSE WEBS

BACKGROUND OF THE INVENTION

The present invention relates to improvements in methods and mechanisms for dewatering fibrous webs and particularly to an improved method and mechanism for forming a web from bagasse fibers.

In the formation of a paper web at high speeds, it is customary to deposit a slurry on a traveling porous forming surface to obtain initial dewatering and formation of the web on the forming surface. The web is then transferred customarily to a press section where additional water is squeezed from the web and then transferred onto a dryer section.

Developments have been made in the art for many years in attempts to improve dewatering of webs in the press section, and to improve reliable handling of webs as they travel through the machine without breaking. Examples of such attempts are disclosed in U.S. Pat. Nos. 3,600,273, 3,600,275, 3,671,389, 2,694,346, 2,850,951, Canadian Pat. Nos. 434,032 and 773,352 and other patents and developments are known to those versed in the art.

It has been discovered that the formation of a web from fibers of bagasse present unique problems not encountered with the formation of web from wood fibers at ordinary speeds. To make a paper web from bagasse fibers, the web must be satisfactorily formed and handled at commercially useful rates of web travel. Also, to make useful web such as for newsprint, the bagasse web must possess the qualities necessary for finished newsprint including adequate ink receptivity, uniformity or one-sidedness so that both sides of the web can be printed on and fiber formation which provides adequate strength and has not been crushed during dewatering. The desirability of providing a successful mechanism and method for handling bagasse is required because of the ready availability of bagasse fibers in certain geographical areas and such fibers being relatively inexpensive.

It has been discovered that among the problems presented by bagasse fibers is that the web in its wet state is relatively weak so that substantial difficulties are encountered in attempting to handle the web, particularly at good speeds. It has been discovered that the wet web is particularly weak until dryness in excess of 30% are reached.

Another difficulty which has been discovered is that bagasse shows a marked tendency to pick on smooth surfaces particularly when wet. Picking is caused by the fibers clinging to traveling surfaces and being pulled from the surface of the web so that the web is spoiled, and the fibers which remain on the machine surfaces will tend to spoil the succeeding traveling web passing through the machine. In handling the bagasse web to bring it to a state of dryness to increase its strength and decrease its tendency to pick, the dewatering must be accomplished in such a manner so that the water is not brought out of the web too rapidly so as to cause crushing. Crushing is a phenomena which occurs in accordance with certain theories by the water being forced out of the web at too high a speed so that internal hydraulic pressures build up to dislodge or dislocate the individual fibers and destroy their orientation and bond. If crushing occurs, the resultant web will be weakened and of poor quality.

Various press structures employ a plain roll, and a fibrous web is laid on the plain roll and successive press rolls are arranged around the plain roll to form successive nips with a felt being passed between the web and the clustered rolls. Advantages are obtained in this type of pressing arrangement in that the web can be successfully pressed without having to be handled in between nips and the water is pressed out of the web successively in the same direction to pass into the felts. However, with a bagasse web, because of the tendency to pick and the weakness of the web, it has been impossible to take advantage of the features of this type of press. The present invention permits using a method and structure wherein such a plain roll press can be employed and coacts with preceding press nips to be able to handle the web and improve the actual operation of the plain roll press by bringing the water level in the web to an amount where its action is more effective and wherein the migration of water in a single direction out of the web can be used to advantage for better and more effective dewatering to improve the quality of the web and place it in a condition of having less moisture when it is passed onto the dryer section of the machine.

In passing the web through the nips formed against the plain roll, improved dewatering is attained without picking, and one theory of operation accounting for this improved dewatering, and by which applicants do not necessarily wish to be bound is that in accordance with the teachings herein contained, the web has reached sufficient dryness so that the water can exit from the web in a single direction at rates caused by relatively high nip pressures, without crushing. Thus, in the third nip, which is the first nip of the plain press roll, water is brought out of the web into the felt and additional water is brought to the outer surface of the web. Having brought the water in this direction toward the surface of the web in the third nip, it exits more effectively and more efficiently in the same direction in the fourth nip. Also, since no water has passed inwardly toward the plain roll, the web is in effect maintained smooth with the fibers against the plain roll remaining lubricated with moisture to reduce the tendency to pick and the fibers will separate easily from the plain roll when the web is removed therefrom.

It is accordingly an object of the invention to provide a method and mechanism which is capable of controlling a wet web of bagasse in such a manner that it is completely supported and controlled during the initial pressing dewatering stages until it reaches a dryness of at least 30% and applying dewatering pressing forces in such a manner that the integrity of the web is protected and crushing does not occur, and that the tendency of the fibers to pick are avoided. A general object of the invention is to provide a method and mechanism which balances the need for rapid and effective dewatering with the need for control and support of a web of relatively weak wet strength so that an improved web results, yet the dewatering operation can take place at satisfactory commercial operating speeds.

A still further object of the invention is to provide a method of dewatering traveling webs of bagasse fibers in such a manner that a uniform web of superior inking quality on both sides results and is particularly well suited to the relatively high speed manufacture of bagasse newsprint.

A feature of the invention is the support of the web on the top surface of a felt almost immediately after it is picked off the forming surface. The web is kept under complete control by being picked off the forming surface by suction pick-off roll which provides no opportunity for the web to break loose and travel downwardly and thereafter the web is transferred onto the upper surface of a traveling press felt and maintained on the top surface of that felt continually through two double felted nips. The web does not depend upon any frictional forces or pressure differential forces to cause it to adhere to the undersurface of a felt, and thus there is no opportunity for any surface fibers on the web to become dislodged or displaced nor for the web fibers in any way to separate due to the weight of the web, nor for the web fibers in any way to separate due to the fact that such web must be carried by being supported along the upper surface of the web as is the case with certain structures heretofore available. By being supported on the top or outer surface of a press felt, the web is gravitationally held in place, and there is no possibility whatsoever of the web being lost or being broken, and the web strength and the relative positions of the fibers are maintained intact at a very critical time in its formation when the moisture level is such that the fibers are attracted to each other, but with insufficient force to maintain web integrity by being handled in the usual manner. A further feature of this arrangement is that the application of pressing pressure is applied at a gently increasing increment due to the twin double felted nips to cause the water to travel in both directions out of the web, but also to cause the water to move out of the web at a gently accelerating rate. While some rewetting occurs on the offrunning side of the felt nips, the rewetting also transpires in a gentle manner so that any tendency to upset the orientation of the fibers is reduced. These features of processing and handling accrue to particular advantage in the formation of a bagasse web, but may also be employed to overcome difficulties in forming a wood fiber web at very high speeds in excess of those which are now commercially feasible.

Other objects and advantages and features will become more apparent, as will equivalent methods and structures which are intended to be covered herein, with the teaching of the principles of the invention in connection with the disclosure of the preferred embodiments in the specification, claims and drawings in which:

IN THE DRAWINGS

FIG. 1 is a somewhat schematic side elevational view of a forming and dewatering section of a paper making machine embodying the principles of the present invention;

FIG. 2 is a somewhat schematic side elevational view of a press section showing an alternate embodiment of the invention.

DESCRIPTION

Figure 3:
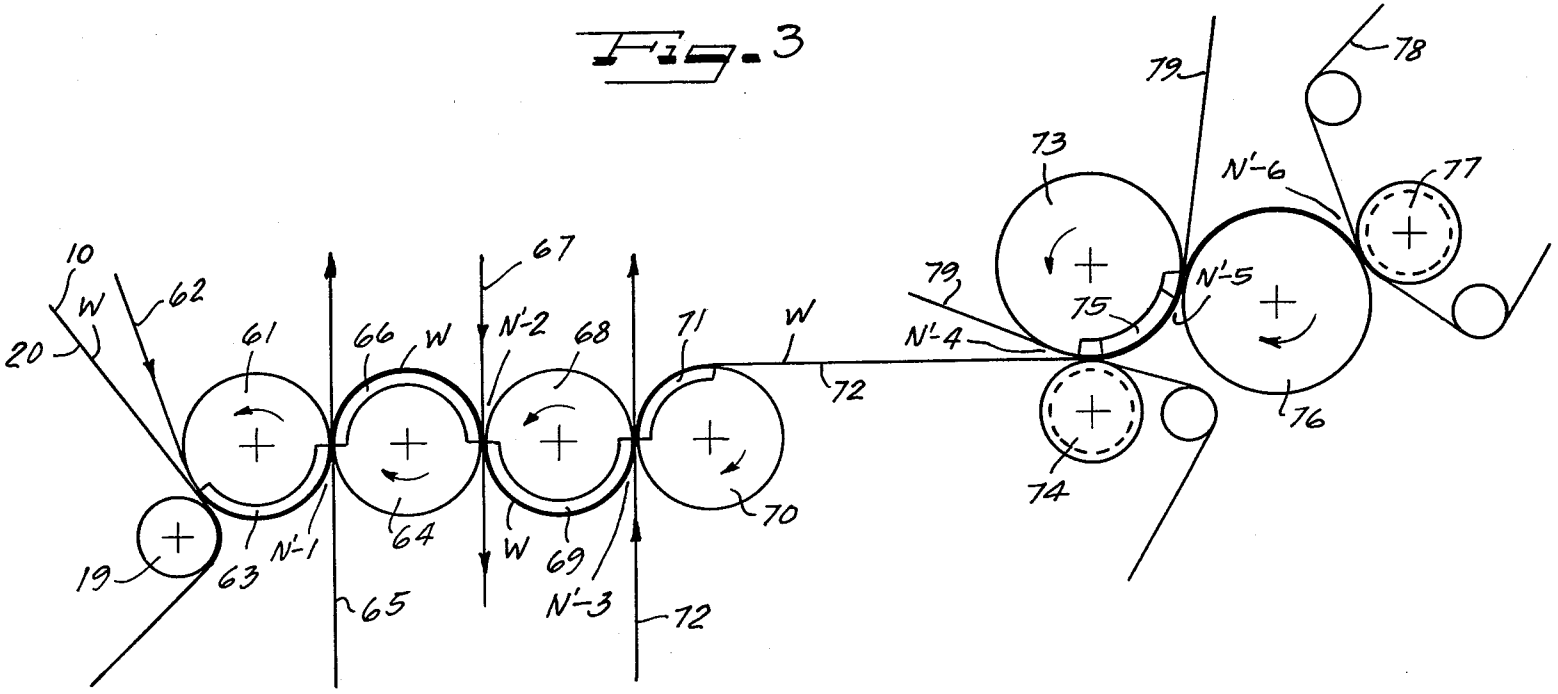
FIG. 3 is a schematic side elevational view of a press section showing a further embodiment of the invention.

As shown in FIG. 1, a web W is formed between two looped forming wires 10 and 11 which are arranged to travel together in a forming run 12. In the forming run, the web being formed is dewatered in both directions by the surface pressure of the traveling wires against the web, and the water on the outer surface of the forming wire 11 will be thrown outwardly to be caught by suitable savealls, not shown, and on the inner surface of the wire 10 the water will be skimmed off the surface of the wire by blades 13 to be caught by suitable savealls, not shown. A slurry of fibrous bagasse stock is delivered to the forming run by a headbox 14 which has a slice opening at the upper tip to deliver a thin layer of slurry into the throat at the lead end of the forming run. The wires are guided at the lead end of the forming run between opposed breast rolls 15 and 16. At the upper end of the forming run, the wire 10 turns over a couch roll 17 having a suction gland **17*a* therein. The wire 11 is wrapped over the couch roll 17 by a couch roll 18 which is positioned generally above the couch roll 17. The web follows the wire 10** as it is turned and travels downwardly. The forming run will result in a web being formed which has been dewatered in both directions so that the fibers will be uniformly formed, and a uniform web with onesided properties, that is a distribution of fibers so that the web is capable of being completed so that both surfaces will have equal physical properties and particularly equal ink receptivity will result. At the end of the forming run, the bagasse web will have a dryness in the order of 22% and will have a very low wet strength. Thus, to handle this web through any open draws will endanger its integrity and probably cause web breakage and consequent disruption to the operation of the machine. Further, the web in that state has a substantial tendency to pick so that if it is laid on a nonporous surface, fibers will be pulled away from the web to damage it. Generally, picking is due to surface adhesion between the fibers against a smooth surface as opposed to internal adhesion of the fibers to each other. Because the internal adhesion is low, the resultant problem is low wet strength and tendency to pick. In accordance with the principles of the invention, the web is uniquely handled by being fully supported and controlled in the initial pressing stages so that no open draws or fluttering can result. Also, it is maintained through the first two nips in a manner so as to have contact only with press felts avoiding any contact with smooth surfaces which could cause picking. The press felts obtain another advantage in the handling of the wet web in that they permit a more gradual application of pressing pressure in the press nips. With a given pounds per linear inch pressure, the double felted nips are capable of applying a more gradual longer sloping pressure curve against the web so as to obtain a fully effective dewatering, but at a more gradual rate to thereby avoid the possibility of crushing the fibers. If the fibers are processed through a hard nip, low nip pressures must be used to avoid the outrush of water though the fibers at a rate which would cause crushing. At lowered nip pressures, less water is removed, and the low wet strength of the bagasse web remains until a certain dryness is achieved. We have discovered this dryness to be on the order of at least 30% before adequate strength and resistance to picking is arrived at to permit placing the web on a smooth surfaced roll. In accordance with the principles of the present invention, the web is completely controlled by being supported on an upwardly facing lower felt and is passed through two double felted nips each of which apply adequate pressure to obtain a dryness of at least 30% and preferably in the range of 30% to 42%.

The utilization of double felted nips accomplishes dewatering in both directions from both surfaces of the traveling web so that the maximum rate of outrush of water can occur to remove maximum water without reaching the crushing velocity stage.

As illustrated in FIG. 1, the web is picked off of a downward run 20 of the forming wire 10, with the downward run being formed as the wire travels from the couch roll 17 down to a turning roll 19. A pickup roll 21 has a segmented suction gland 22 therein for lifting the web off of the wire 10, and the pickup roll carries a press felt 25 over its surface. The press felt is maintained in kissing contact with the surface of the web so that continual support is maintained on the web as it is lifted off the wire and travels around the undersurface of the roll 21 maintained thereon by the suction. The web is brought up into a first nip N-1 formed between the pickup roll 21 which serves as an upper press roll, and a lower press roll 23 which is wrapped by a second press felt 26. The lower press roll is a suction roll having a segmented suction gland 24 therein. The upper and lower press rolls 21 and 23 are provided with mechanism for obtaining the desired nip pressures, and this mechanism is designed to provide a controlled nip pressure which may be set to be in the range of 200 to 250 pounds per linear inch and optimumly at 225 pli.

The upper felt 25 is arranged so that it is lifted away from the lower felt 26 following the press nip N-1, and the suction gland 24 causes the web to follow the lower felt 26. The web is supported on the upwardly facing surface of the felt 26 and travels along a run 27 into the second double felted nip N-2. This nip is formed between an upper press roll 28 and a lower press roll 29. The upper press roll has a sectioned suction gland 31 therein, and the lower press roll is provided with grooves at 30. The lower felt 26 passes through the nip, and an upper felt 32 is threaded into the nip so that the web is sandwiched therebetween. The press rolls 28 and 29 are provided with adequate controlled pressing structure and preferably that their nip pressures are adjusted in the range of 300 to 350 pli. The first and second nips will thus cause a substantial removal of water from the web with a substantial uniform removal from both sides thereof, at rates which do not approach the web crushing rate. The web will have reached a dryness of at least 30% before passing into the third nip, and preferably in the range of 30% to 42% so that the web by this time will have achieved an amount of strength and the tendency to pick will be substantially reduced to a degree whereby it can safely be laid on a smooth surfaced roll. The web by virtue of the suction gland 31 follows the upper felt 32 and is laid onto the surface of a smooth surfaced roll 33. The upper press roll 28 of the second nip forms a third press nip N-3 with the smooth surfaced roll 33, and the upper felt 32 passes through the third nip N-3 on the outer surface of the web.

The web is carried on the smooth outer surface of the roll 33 and passes through a fourth nip N-4. The fourth nip is formed between an outer roll 34 and the smooth surfaced roll 33. The roll 34 has grooves 35 therein and a felt **35*a* is guided into the nip N-4 and away from such nip by guide rolls 36 and 37. Following the fourth nip, the web may be transferred to a dryer felt to be carried to a dryer section of the machine, or may, as is shown in FIG. 1, pass down through a fifth nip N-5. This fifth nip is formed between a press roll 38 and the smooth surfaced roll 33. A felt 39 is led into the fifth nip on the outer surface of the web to receive water expressed therefrom. The press roll 38 is provided with a suction gland 38*a* which lifts the web off the surface of the roll 33 and carries the web down onto a dryer felt 41. At the transfer location, the dryer felt is supported on a roll 40 which has a suction transfer gland 43 therein to cause the web to follow the dryer felt and be carried over a series of dryer drums such as drum 42**.

In the third press nip the press roll 28 is arranged so that it preferably operates at a pressure in the range of 350 to 400 pli. In the fourth press nip, a pressure range in excess of 500 pli. may be used, and this pressure can also be used in the fifth press nip. Transfer pressures such as between the rolls 38 and 40 are at adequate transfer pressures on the order of 25 pli.

As illustrated in FIG. 2, a web is formed in a twin wire former such as shown and described in connection with FIG. 1, and is picked off the traveling forming wire 10 by a felt 25 which passes over a pickup roll 52 having a suction gland 53 therein. The web then passes through a first press nip formed between the roll 52 and a press roll 50 having grooves 51. A felt 26 passes through this first nip carried over the roll 50 and into contact with the web. The web is then sandwiched between the pair of felts 25, 26 and passes through a second press nip formed between the roll 50 and a roll 54 having grooves 55. The web, carried between the two felts then passes through a third nip formed between a roll 28 having a suction gland 31 and a roll 29 having grooves 30. The web follows the upper felt around the suction gland 31 and passes through another press nip between the roll 28 and an unnumbered plain roll.

As illustrated in FIG. 3, a forming wire 10 travels downwardly through run 20 passing over a turning roll 19, carrying a web W on its upper surface. A pickup roll 61 carries a felt 62 and picks the web off of the wire 10. A suction gland 63 is located inside of the pickup roll for carrying the web and performing a initial dewatering over the arc of the gland 63. The web is carried through a first nip N'-1 formed between the roll 61 and a press roll 64. The nip N'-1 is double felted between the felt 62 and a felt 65 which wraps the upper surface of the roll 64 over the arc of a suction gland 66 within the roll 64. The web is then carried through a succession of nips, the nect being designated N'-2 and formed between the roll 64 and a roll 68. The web travels on the felt 67 around a suction gland 69 on the lower side of the roll 68, and enters a third nip designated N'-3. The third nip is formed between the roll 68 and a roll 70. A felt 72 passes through the third nip, and the web follows the felt 72 along a suction gland 71 within the roll 70, and then travels along the top surface of the felt 72 into a fourth nip N'-4. The fourth nip is formed between a suction roll 73 and a lower grooved roll 74. An upper felt 79 passes into the nip N'-4 sandwiching the web W therebetween. The web then follows the felt 79 along a suction gland 75 within the roll 73, and enters a fifth nip N'-5 formed between the roll 73 and a solid roll 76. The roll 76 is a smooth surfaced roll, and the web is pressed into contact with such smooth surface so as to follow the roll surface on the outgoing side of the nip N'-5 into a nip N'-6. A felt 78 passes into the nip N'-6 on the outer surface of the web with the nip N'-6 being formed between the roll 76 and a grooved roll 77. The web W at this point will have been dewatered sufficiently to have adequate body to be handled by successive drawing equipment.

Certain of the problems encountered with the formation of a web from bagasse are also encountered with the formation of a web from wood fibers at exceedingly high speeds. Thus, the mechanism herein provided is suited to the formation of a wood fiber web at high speeds, and the disclosed structure is not limited for use for bagasse only which is recited as a preferred environment for utilizing the features of the invention. As the speed of commercial machines increases, it is anticipated that speeds of 5,000 feet per minute and above for newsprint may be employed and with these high speeds, which are presently unattainable in commercial machines, the present structural arrangement will enable the solution of problems which are not present in slower speed machines.

In accordance with the present invention, after the web has been provided with wet strength through the dewatering as discussed in both directions in the double felted nips, it is subjected to two or more press nips which remove water in the same direction from the web. This provides full support to the web on a plain smooth surfaced roll and provides the advantage of having the water migrate out of the web in the same direction in each successive nip at a web condition where it has sufficient dryness so that crushing cannot occur. The formed web retains its one-sided characteristic, i.e., the web has uniform properties on both sides.

We claim as our invention:

1. The method of forming a continuous web from a slurry of bagasse fibers comprising:

projecting a slice stream of bagasse slurry between a pair of looped traveling forming wires and draining water through the wires for forming a one-sided web;

lifting the formed web off one of the wires and substantially immediately passing the web through a first press nip sandwiched between a first upper press felt and a second lower press felt for pressing water uniformly from the web in both directions;

passing the web through a second press nip sandwiched between said second press felt and a third press felt and supporting the web from the one forming wire continuously through said first nip on the lower surface of the first felt, supporting the web on the second press felt from the first nip through the second nip;

laying the web on a plain roll after the second nip, supporting the web continuously on said third felt between the second nip and plain roll;

pressing the web against the plain roll in a third nip with the third nip formed between the third press felt and the plain roll;

maintaining the web on the plain roll after the third nip and passing the web against the plain roll in a fourth nip with a fourth press felt being outwardly of the web;

removing the web from the plain roll after the fourth nip for transfer to a dryer section;

applying a pressure in the first press nip in the range of 200 to 250 pounds per linear inch;

applying a pressure in the second nip in the range of from 300 to 350 pounds per linear inch;

applying a pressure in the third press nip in the range of 350 to 400 pounds per linear inch;

and applying a pressure in the fourth nip in excess of 500 pounds per linear inch.

2. The method of forming a continuous web from a slurry of bagasse fibers in accordance with the steps of claim 1:

including pressing the web against the plain roll in a fifth nip with a fifth press felt outwardly of the web.

3. The method of forming a continuous web from a slurry of bagasse fibers in accordance with the steps of claim 1:

including drying the web in the first and second nips to a dryness of at least 30% before the web reaches the third press nip.

4. The method of forming a continuous web from a slurry of bagasse fibers in accordance with the steps of claim 1:

including drying the web to a dryness of 30% to 42% in the first and second nips prior to the web reaching the third nip.

* * * * *

UNITED STATES PATENT AND TRADEMARK OFFICE

CERTIFICATE OF CORRECTION

PATENT NO. : 4,086,131
DATED : April 25, 1978
INVENTOR(S) : Cornelius N. Rempel & Merle G. Linkletter It is certified that error appears in the above-identified patent and that said Letters Patent are hereby corrected as shown below:

Column 8, line 10, change "passing" to ---pressing---

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*